US012454879B1

(12) United States Patent
Roach et al.

(10) Patent No.: US 12,454,879 B1
(45) **Date of Patent: *Oct. 28, 2025**

(54) PERFORATING GUN AND METHOD OF USING SAME

(71) Applicant: Reach Wireline, LLC, Fort Worth, TX (US)

(72) Inventors: John P. Roach, Fort Worth, TX (US); Daniel Tollefson, Fort Worth, TX (US); Chris Payson, Fort Worth, TX (US); Jerred Smith, Fort Worth, TX (US)

(73) Assignee: Reach Wireline, LLC, Fort Worth, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/746,027

(22) Filed: Jun. 17, 2024

Related U.S. Application Data

(63) Continuation of application No. 17/454,777, filed on Nov. 12, 2021, now Pat. No. 12,012,829, which is a (Continued)

(51) Int. Cl.
*E21B 43/1185* (2006.01)
*E21B 43/117* (2006.01)

(52) U.S. Cl.
CPC ..... *E21B 43/1185* (2013.01); *E21B 43/117* (2013.01)

(58) Field of Classification Search
CPC .. E21B 43/119; E21B 43/116; E21B 43/1185; E21B 47/13; F42D 1/045; F42D 1/04
See application file for complete search history.

(56) References Cited

U.S. PATENT DOCUMENTS 4,967,048 A 10/1990 Langston
5,167,282 A 12/1992 Schneider et al.
(Continued)

FOREIGN PATENT DOCUMENTS

CN 202325445 U 7/2012
RU 2635929 C1 11/2017
(Continued)

OTHER PUBLICATIONS

Non-final office action, dated Jul. 13, 2023, 7 pages, issued in U.S. Appl. No. 17/518,159.

*Primary Examiner* — Daniel P Stephenson
(74) *Attorney, Agent, or Firm* — AVEK IP, LLC

(57) ABSTRACT

A perforating gun includes a charge tube, a switch carrier body, and a pin contact spacer. The switch carrier body houses an addressable switch, a spring tube which holds a spring, a detonation block, a removable interrupter, and a pin contact spacer supporting a pin contact assembly. The spring biases a switch contact terminal towards an outer surface of the switch carrier body, and the switch contact terminal is electrically connected to the addressable switch. The interrupter includes first and second portions, and is temporarily adhered to the switch carrier body such that the first portion covers the switch contact terminal and the second portion extends between a detonation cord and an instantaneous detonator in the detonation block. A first end of the charge tube is positioned around the switch carrier body, and a second end of the charge tube is secured to the pin contact space.

20 Claims, 11 Drawing Sheets

Related U.S. Application Data continuation-in-part of application No. 17/518,159, filed on Nov. 3, 2021, now abandoned, which is a continuation-in-part of application No. 17/182,420, filed on Feb. 23, 2021, now abandoned.

(60) Provisional application No. 63/263,377, filed on Nov. 1, 2021, provisional application No. 62/982,217, filed on Feb. 27, 2020.

(56) References Cited

U.S. PATENT DOCUMENTS

| | | | |
|---|---|---|---|
| 5,237,136 | A | 8/1993 | Langston |
| 5,273,121 | A | 12/1993 | Kitney et al. |
| 5,571,986 | A | 11/1996 | Snider et al. |
| 5,837,925 | A | 11/1998 | Nice |
| 6,742,602 | B2 | 6/2004 | Trotechaud |
| 6,865,792 | B2 | 3/2005 | Kash |
| 6,865,978 | B2 | 3/2005 | Kash |
| 6,926,096 | B2 | 8/2005 | Kash |
| 7,055,421 | B2 | 6/2006 | Kash |
| 7,237,626 | B2 | 7/2007 | Gurjar et al. |
| 7,360,487 | B2 | 4/2008 | Myers, Jr. et al. |
| 7,441,601 | B2 | 10/2008 | George et al. |
| 8,220,394 | B2 | 7/2012 | Bates et al. |
| 8,469,087 | B2 | 6/2013 | Gray |
| 8,544,563 | B2 | 10/2013 | Bourne et al. |
| 8,875,787 | B2 | 11/2014 | Tassaroli |
| 9,062,543 | B1 | 6/2015 | Snider et al. |
| 9,080,431 | B2 | 7/2015 | Bell et al. |
| 9,115,572 | B1 | 8/2015 | Hardesty et al. |
| 9,145,764 | B2 | 9/2015 | Burton et al. |
| 9,194,219 | B1 | 11/2015 | Hardesty et al. |
| 9,243,472 | B1 | 1/2016 | Snider et al. |
| 9,382,784 | B1 | 7/2016 | Hardesty et al. |
| 9,476,289 | B2 | 10/2016 | Wells |
| 9,562,421 | B2 | 2/2017 | Hardesty et al. |
| 9,598,942 | B2 | 3/2017 | Wells et al. |
| 9,677,363 | B2 | 6/2017 | Schacherer et al. |
| 9,689,238 | B2 | 6/2017 | Hardesty et al. |
| 9,752,406 | B2 | 9/2017 | Hardesty et al. |
| 9,759,049 | B2 | 9/2017 | Hardesty et al. |
| 9,784,549 | B2 | 10/2017 | Eitschberger |
| 9,822,618 | B2 | 11/2017 | Eitschberger |
| 9,835,006 | B2 | 12/2017 | George et al. |
| 9,835,015 | B2 | 12/2017 | Hardesty |
| 9,845,666 | B2 | 12/2017 | Hardesty et al. |
| 10,036,236 | B1 | 7/2018 | Sullivan et al. |
| 10,077,641 | B2 | 9/2018 | Rogman et al. |
| 10,161,733 | B2 | 12/2018 | Eitschberger et al. |
| 10,174,595 | B2 | 1/2019 | Knight et al. |
| 10,180,037 | B2 | 1/2019 | Hardesty et al. |
| 10,480,276 | B2 | 11/2019 | Snider et al. |
| 10,584,950 | B2 | 3/2020 | Saltarelli et al. |
| 10,612,340 | B2 | 4/2020 | Snider et al. |
| 10,641,068 | B2 | 5/2020 | Hardesty et al. |
| 10,669,821 | B2 | 6/2020 | Knight et al. |
| 10,731,444 | B2 | 8/2020 | Wells et al. |
| 10,844,697 | B2 | 11/2020 | Preiss et al. |
| 10,845,177 | B2 | 11/2020 | Preiss et al. |
| 10,858,920 | B2 | 12/2020 | Wells |
| 10,900,334 | B2 | 1/2021 | Knight et al. |
| 10,900,335 | B2 | 1/2021 | Knight et al. |
| 10,920,544 | B2 | 2/2021 | Sullivan et al. |
| 10,927,665 | B2 | 2/2021 | Ende |
| 10,934,794 | B2 | 3/2021 | Knight et al. |
| 10,934,795 | B2 | 3/2021 | Wells |
| 10,954,723 | B2 | 3/2021 | Sullivan et al. |
| 11,021,923 | B2 | 6/2021 | Mulhern et al. |
| 11,078,763 | B2 | 8/2021 | Anthony et al. |
| 11,215,041 | B2 | 1/2022 | Knight et al. |
| 11,293,737 | B2 * | 4/2022 | Sullivan ..... F42D 1/05 |
| 11,555,384 | B2 | 1/2023 | Knight et al. |
| 12,012,829 | B1 | 6/2024 | Roach et al. |
| 2013/0008669 | A1 | 1/2013 | Deere et al. |
| 2013/0126237 | A1 | 5/2013 | Burton et al. |
| 2013/0153205 | A1 | 6/2013 | Borgfeld et al. |
| 2015/0007994 | A1 | 1/2015 | Lancaster et al. |
| 2016/0047194 | A1 | 2/2016 | Snider et al. |
| 2016/0047195 | A1 | 2/2016 | Snider et al. |
| 2016/0356132 | A1 | 12/2016 | Burmeister et al. |
| 2018/0094511 | A1 | 4/2018 | Hardesty |
| 2019/0085664 | A1 | 3/2019 | Hardesty et al. |
| 2019/0106962 | A1 | 4/2019 | Lee et al. |
| 2019/0153827 | A1 | 5/2019 | Goyeneche |
| 2019/0219375 | A1 | 7/2019 | Parks et al. |
| 2019/0277103 | A1 | 9/2019 | Wells et al. |
| 2019/0330947 | A1 * | 10/2019 | Mulhern ..... E21B 23/0414 |
| 2020/0199983 | A1 | 6/2020 | Preiss et al. |
| 2020/0217148 | A1 | 7/2020 | Massey et al. |
| 2020/0217635 | A1 | 7/2020 | Eitschberger |
| 2020/0256166 | A1 | 8/2020 | Knight et al. |
| 2020/0332630 | A1 | 10/2020 | Davis et al. |
| 2020/0347694 | A1 | 11/2020 | Power et al. |
| 2021/0277752 | A1 | 9/2021 | Eitschberger |
| 2022/0018226 | A1 | 1/2022 | Wells et al. |
| 2022/0120165 | A1 * | 4/2022 | Shelton ..... E21B 43/116 |
| 2022/0258103 | A1 | 8/2022 | Eitschberger et al. |

FOREIGN PATENT DOCUMENTS

| | | | |
|---|---|---|---|
| RU | 2700122 | C1 | 9/2019 |
| WO | 2022229036 | A1 | 11/2022 |

* cited by examiner

PERFORATING GUN AND METHOD OF USING SAME

CROSS-REFERENCE TO RELATED APPLICATIONS

This application is a continuation of U.S. patent application Ser. No. 17/454,777, filed Nov. 12, 2021, which is pending and which is a continuation-in-part of U.S. patent application Ser. No. 17/518,159, filed Nov. 3, 2021, which is abandoned, and which is a continuation-in-part of U.S. patent application Ser. No. 17/182,420, filed Feb. 23, 2021, which is pending and claims the benefit of priority of U.S. Provisional Patent Application No. 62/982,217, filed Feb. 27, 2020. U.S. Patent Application '777 also claims priority to U.S. Provisional Patent Application No. 63/263,377, filed Nov. 1, 2021. The disclosure of each of these applications is incorporated by reference herein in its entirety.

FIELD OF THE INVENTION

The invention relates generally to perforating guns utilized in fracturing oil and gas wells. More particularly, the invention is directed to a tool, system, and means of connecting perforating gun clusters together to be used in subterranean well applications.

SUMMARY

The following presents a simplified summary of the invention in order to provide a basic understanding of some aspects of the invention. This summary is not intended to identify critical elements of the invention or to limit the scope of the invention. Its sole purpose is to present some concepts of the invention in a simplified form as a prelude to the more detailed description provided below.

In one embodiment, a perforating gun system includes at least one perforating gun, and a tandem sub. Each perforating gun includes a charge tube having a first end and a second end for holding a shaped charge; a switch carrier having a body with a lower face and a flange extending circumferentially around the lower face defining a space between the flange and the body, with an addressable gun switch housed within the body; and a pin contact spacer that supports a pin contact assembly that extends outwardly from the pin contact spacer. The first end of the charge tube is positioned around the switch carrier in the space between the flange and the body, and the second end of the charge tube is secured to the pin contact spacer. The tandem sub has a bore defined therethrough, and the bore has a first bore section having a first diameter and a second bore section having a second diameter that is less than the first diameter. The switch carrier having the first end of the charge tube positioned therearound of a first of the at least one perforating gun is positioned within the first bore section of the tandem sub. The pin contact spacer of a second of the at least one perforating gun is positioned substantially adjacent the tandem sub such that the pin contact assembly is received into the second bore section of the tandem sub. The pin contact assembly of the second of the at least one perforating gun contacts the switch carrier of the first of the at least one perforating gun to provide an electrical connection between the first and the second of the at least one perforating gun.

In another embodiment, a perforating gun includes a charge tube having a first end and a second end for holding a shaped charge, a switch carrier body, and pin contact spacer. The switch carrier body includes an addressable switch, a spring tube, a detonation block, and a removable interrupter. The spring tube houses a spring, and the spring biases a switch contact terminal towards an outer surface of the switch carrier body. The switch contact terminal is directly electrically connected to the addressable switch. The detonation block holds a detonation cord and an instantaneous detonator. The removeable interrupter includes a first portion and a second portion extending from the first portion, and is temporarily adhered to the switch carrier body such that the first portion covers the switch contact terminal and the second portion extends between the detonation cord and the instantaneous detonator in the detonation block. The pin contact spacer includes a pin contact assembly which is secured to and extends outwardly from the pin contact spacer. The first end of the charge tube is positioned around the switch carrier body, and the second end of the charge tube is secured to the pin contact spacer.

In still another embodiment, a method of forming and operating a perforating gun system includes (1) providing a first perforating gun; and (2) providing first and second hollowed tandem subs, each tandem sub comprising a first hollowed section having a first diameter and a second hollowed section having a second diameter that is less than the first diameter. The first perforating gun includes a charge tube having a first end and a second end for holding a shaped charge, a switch carrier, a pin contact spacer, and a barrel. The switch carrier houses an addressable switch, a spring tube, and a detonation block for holding a detonation cord and an instantaneous detonator. The spring tube holds a spring which biases a switch contact terminal towards an outer face of the switch carrier, and the switch carrier is directly electrically connected to the addressable switch. The pin contact spacer includes a pin contact assembly that is connected to the switch contact terminal and extends outwardly from the pin contact spacer. The barrel houses the charge tube, the switch carrier, and the pin contact spacer with the pin contact assembly. The first end of the charge tube is positioned around the switch carrier such that the switch contact terminal is accessible, and the second end of the charge tube is secured to the pin contact spacer. Each tandem sub has a first hollowed section having a first diameter and a second hollowed section having a second diameter that is less than the first diameter. The method continues by (3) positioning the switch carrier having the first end of the charge tube positioned therearound into the first hollowed section of the first tandem sub; (4) positioning the pin contact assembly into the second hollowed section of the second tandem sub; and (5) threadably attaching the barrel to the first tandem sub at a first end thereof and to the second tandem sub at a second end thereof.

DETAILED DESCRIPTION

Figure 1:
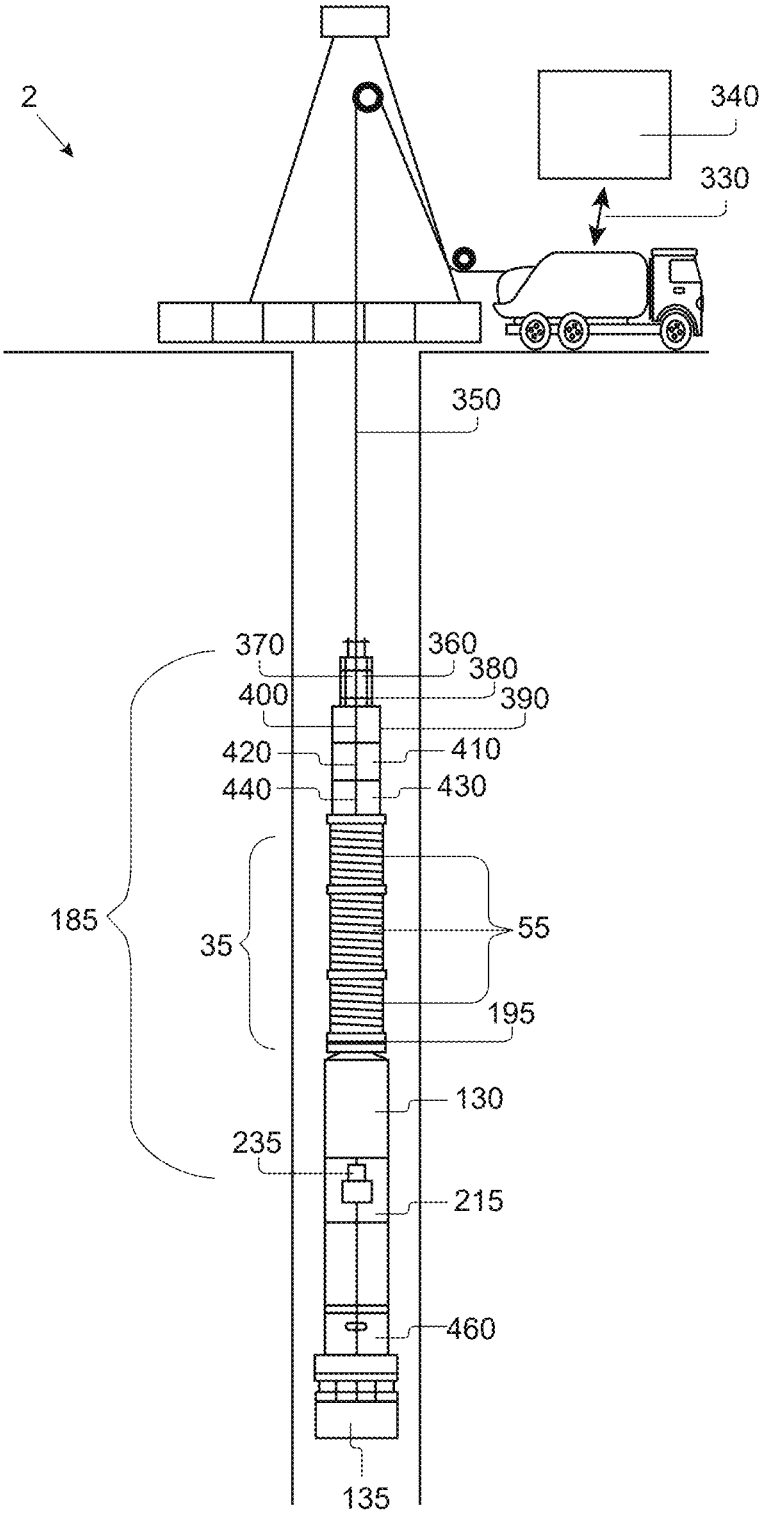
FIG. 1 illustrates a drilling string that utilizes a plurality of perforating guns according to embodiments of the invention.

Hydraulic fracturing is a well stimulation technique in which rock is fractured by a pressurized liquid. The process involves injecting high-pressure fracturing fluid (primarily water containing sand or other proppants suspended with the aid of thickening agents) into a wellbore to create cracks in deep-rock formations. Small grains of hydraulic fracturing proppants remain in the wellbore to hold the fractures open. Natural gas, petroleum, and brine can then flow more freely through the cracks.

Before hydraulic fracturing can occur, the casing in a wellbore must be perforated. Perforating gun systems have been used in oil and gas exploration for many years to create holes in the wellbore casing leading to the subterranean rock in order to provide a flow path for the hydrocarbons (oil and gas) trapped in the rock to enter the well. To make these holes, explosives are used to create a blast of energy that cuts through metal tubulars and cement and some distance into the rock containing the oil and gas. Perforating gun systems can be conveyed on wireline that is connected to a specialty wireline truck or tubing that is handled on a rig of some sort or coil tubing.

In the case of hydraulic fracturing operations of oil and gas wells, a perforating gun system, or perforating tool string, is typically deployed on a wireline and comprises a pressure isolation plug on bottom, a plug setting tool, one or more perforating guns, a means for mechanically disconnecting the wireline from the guns, and a collar locator that is used for depth control. The tool string is connected to the wireline with a device called a cable head that provides mechanical and electrical connection between the wireline cable and the tool string. Sometimes, weight bars are connected at the top of the tool string to provide additional weight to the string to provide stability when the wireline tools are near the wellhead and also to increase speed of deployment of the wireline through the wellbore when being deployed to total depth.

One individual perforating gun is referred to as a cluster and multiple clusters normally make up a string, as one well typically requires multiple perforating and fracturing operations to complete the well prior to allowing oil and gas to flow out of the rock formation via the well.

In operation, the isolation plug is first set below the targeted zone, then multiple clusters are shot in order to provide several entry points through the targeted zone. The shots are fired from the bottom of the tool string to the top, and each event is considered to be destructive to that cluster so most parts are not reusable upon completion.

A switch is electrically connected inside each gun cluster to control the series of detonation of the gun clusters. The switch may be controlled by a diode that functions on and off depending on the direction of the current, or the switch may use a computer processor called an addressable switch that can receive a coded signal to detonate the gun clusters in proper order. In the case of the diode-controlled switch, at the time of detonation, the technician at surface will see a current signal go up to point of activation and then subsequently fall back to zero amperes showing what is called an 'open' circuit. This electrical response is a positive indication that the gun functioned as intended and the operation can move forward with confidence to the next cluster for detonation. Sometimes, the diodes fail to allow any current to pass through, and the technician has very limited options to fix the issues and must pull out of the well to determine cause of failure.

In the case of an addressable switch, when the technician operates the switch, a computer sends and receives coded signals in order to identify and detonate the correct gun cluster. At the time of operation, the technician sees the current go up to point of detonation when the change in current will stop very briefly, or possibly not at all, then continue to full current showing a "short circuit" in the system. The technician does not get positive indication that the switch and gun functioned properly until the computer goes through the process of communicating with all remaining functional switches down hole, and the one that just fired is no longer able to communicate with the computer. It could be that the short signal indicates that one of the wires in the gun string has a bad connection, and the increase in voltage and current can cause the tools to short somewhere else. The need for communication with the switch every shot limits the speed of operation, but if a switch does not work properly the technician has the option of skipping one or more guns and firing others so that at least some guns still fire properly. The resolution could be to shoot remaining gun clusters and then go back and shoot the missing zones of interest, or to change the frack design according to the actual number of successful clusters. Having this option for successful shot confirmation through the computer is an advantage over the diode-controlled switch, but it is a slower operation.

The energy shockwave from the perforating guns can create unintended incidents or disturbances to the functionality of any of the tool string's components. This can lead to failures, particularly in the components that make up a cluster. Therefore, most gun systems have some type of pressure containing bulkhead located between the clusters that is designed to allow for electrical current to pass through from one cluster to another, and yet be strong enough to contain the energy from the explosion and subsequent hydrostatic pressure from the wellbore after the perforations are made. Some issues with this approach on a large scale can include an inability to control the energy with the mechanical components, or to control the quality of the parts both in manufacturing and the quality of the local operation. Further, the most effective solutions can be very complicated or expensive.

It is desirable to provide a means of connecting perforating gun clusters together to be used in subterranean well applications that allows for components to be housed in the connection sub between clusters and creates a high-pressure seal from the explosion that takes place in the lower clusters. Preferably, although not necessarily, every event will create a high-pressure seal until all guns in the string have been fired. The invention described herein provides a relatively inexpensive and more reliable apparatus that may also provide time-saving benefits as compared to the prior art.

As will be described in greater detail below, the invention is generally directed to a new and improved perforating gun for use in well fracturing operations. Each gun includes a gun barrel, tandem sub, charge tube inside the barrel to hold shaped charges, end pieces on the charge tube, an addressable switch to fire the gun cluster at a specific time, and means for providing pressure isolation between clusters. A contact pin may be used to trigger the pressure isolation. Multiple guns may be operably connected to form a larger perforating gun system. The gun system is generally used in well fracturing operations; however, it shall be understood that the system may be utilized for other well applications, including but not limited to water retrieval, for example.

Referring first to FIG. 1, a perforating tool arrangement 2 includes a perforating gun system 35, which is made up of one or more clusters 55 (each cluster 55 being a perforating gun 1 as illustrated in further drawings) that are operable to perforate a wellbore ahead of hydraulic fracturing operations. As is understood by those of skill in the art, each of the components of the perforating tool arrangement 2 may be in electrical communication with the surface such that an operator on the surface can control the operations of the various components of the perforating tool arrangement 2. More specifically, an electrical positive signal 330 is initiated from the operator computer 340 and is transferred to the tool string 185 via connecting wireline 350 or other means known to those in the art. The tool string 185 includes a cable head 360 where a center wire 370 of the wireline 350 is a conductor and an outer wireline 380 of the wireline 350 is a ground. The cable head 360 is connected to a casing collar locator 390 via wire 400. The casing collar locator 390 is connected to a ballistic release tool 410 via wire 420. Finally, a top sub 430 is connected to a ballistic release tool 410 via connection 440, and the top sub 430 is connected to the first gun cluster 55 of the perforating gun system 35 and first gun cluster 55 via the pin contact assembly 100 with pin 105. As will be described in greater detail below, the each of the gun clusters 55 is electrically connected via corresponding pin contact assembly 100 with pin 105. The perforating gun system 35, and specifically, the bottom gun cluster 195 is operably connected to the plug shoot adapter 130, which connects to a plug-setting tool 215, a wireline adapter kit 460, and ultimately a frac plug 135.

Figure 6:
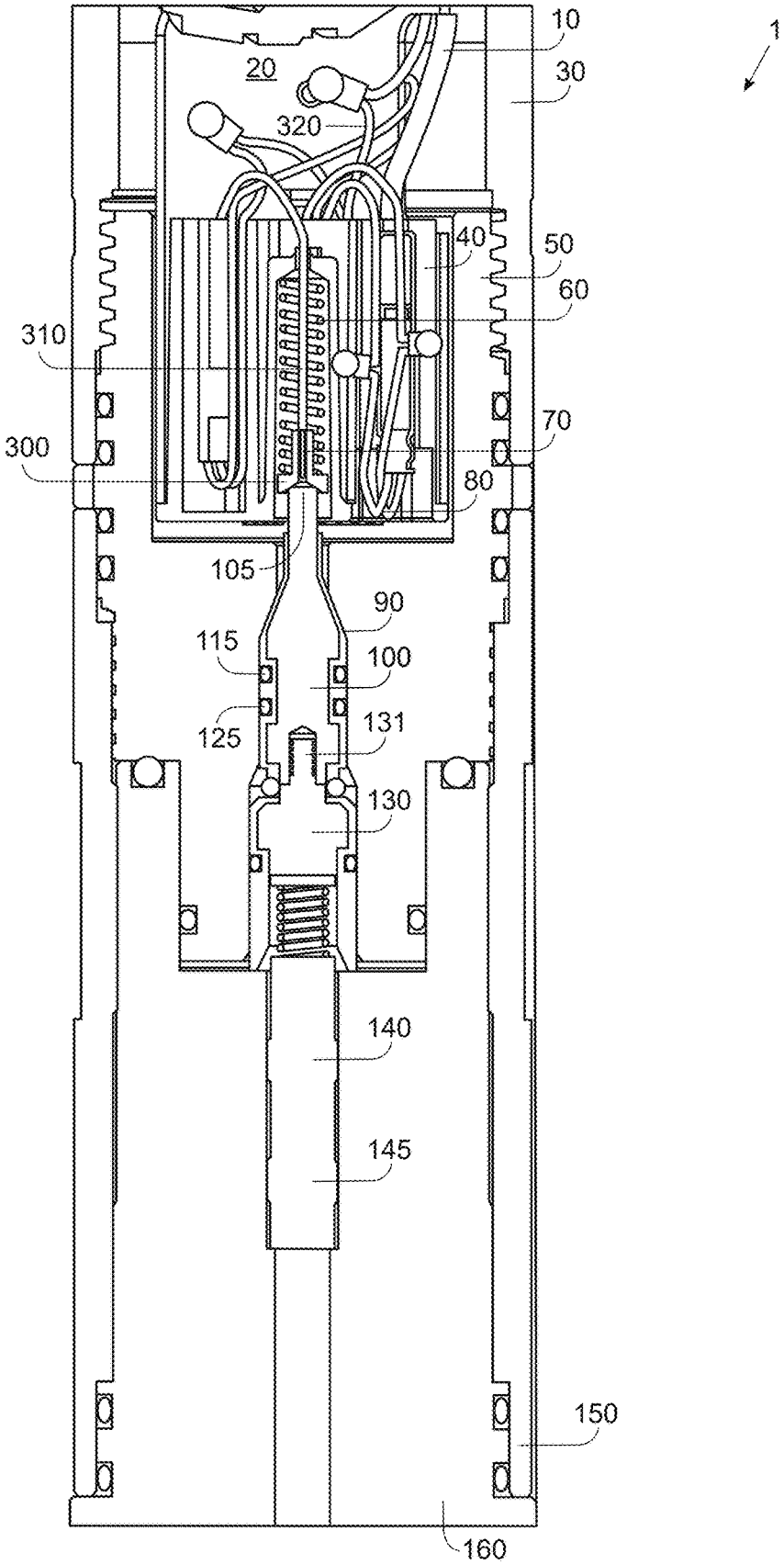
FIG. 6 is a section view of a perforating gun depicting a PSA dynamic seal activated according to embodiments of the invention.

The bottom gun cluster 195 is electrically connected to the plug shoot adapter 130. This is best illustrated in FIG. 6, showing the plug shoot adapter 130 operably connected to an instantaneous ignitor 140 for a power charge 145. The plug shoot adapter 130 is housed within a plug shoot adapter makeup sleeve 150, and connects the bottom most gun 195 to a go-style quick change top connection 160. As is understood by those of skill in the art, the power charge 145 is detonated via the ignitor 140, which receives a signal 330 from the surface. In this case, when the power charge 145 is detonated, the pin contact assembly 100 together with the pin 105 creates a high-pressure seal between the gun 195 and the plug shoot adapter 130/plug-setting tool 215, as will be described in greater detail below.

The contact pin 105 in FIG. 6 can be used as a simple connection point between the bottom gun cluster 195 and the plug-setting tool 215 via the plug shoot adapter 130. An extension 131 on the plug shoot adapter 130 conducts electrical current through the plug shoot adapter 130 to power an ignitor 235 in the plug-setting tool 215. A material may be molded over the electrical conductor in the plug pin extension 131, and the material may be chosen to handle the higher pressures and temperatures generated by the plug setting power charge 145.

Figure 2:
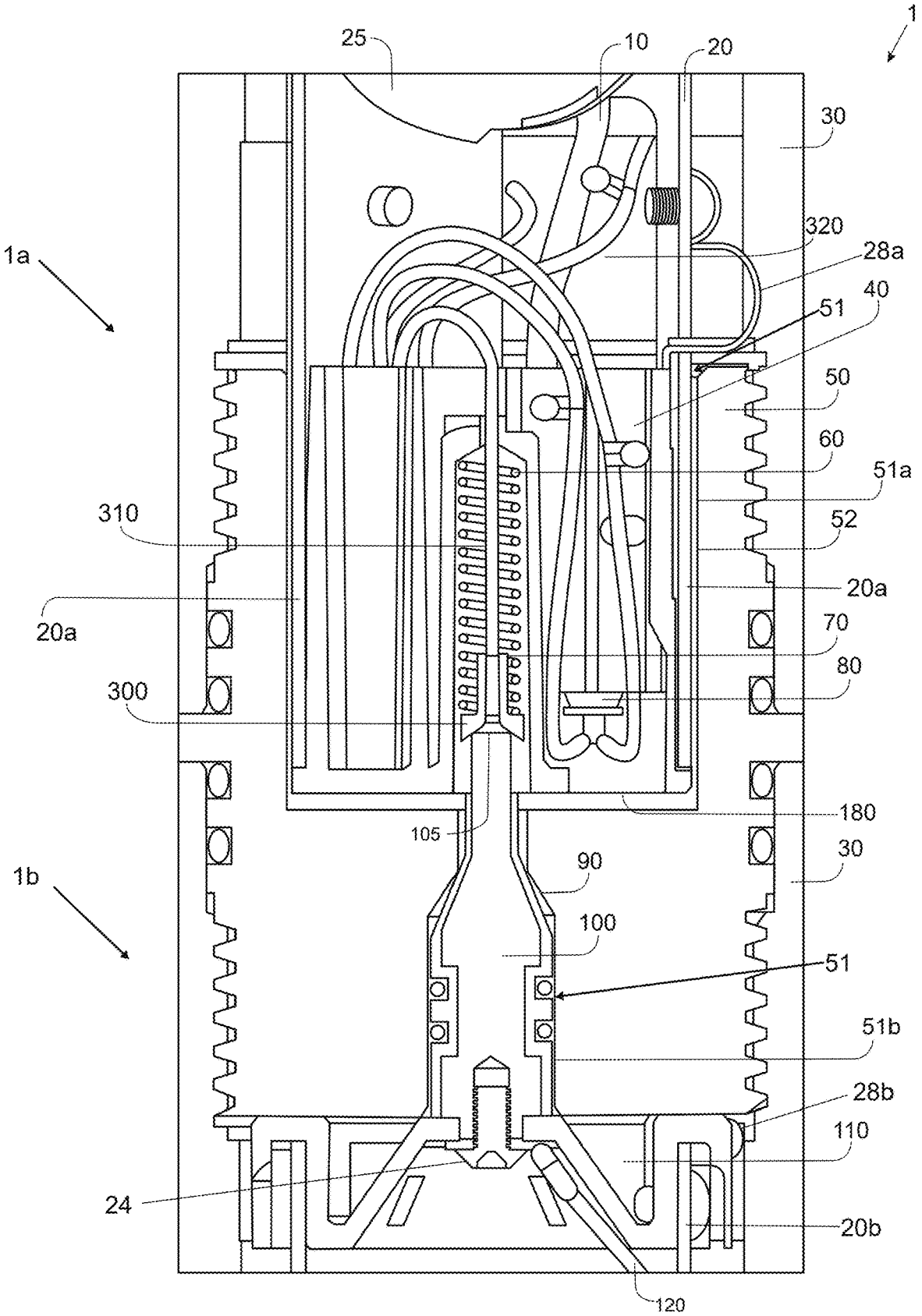
FIG. 2 is a section view of a portion of a perforating gun in accordance with embodiments of the invention.
Figure 3:
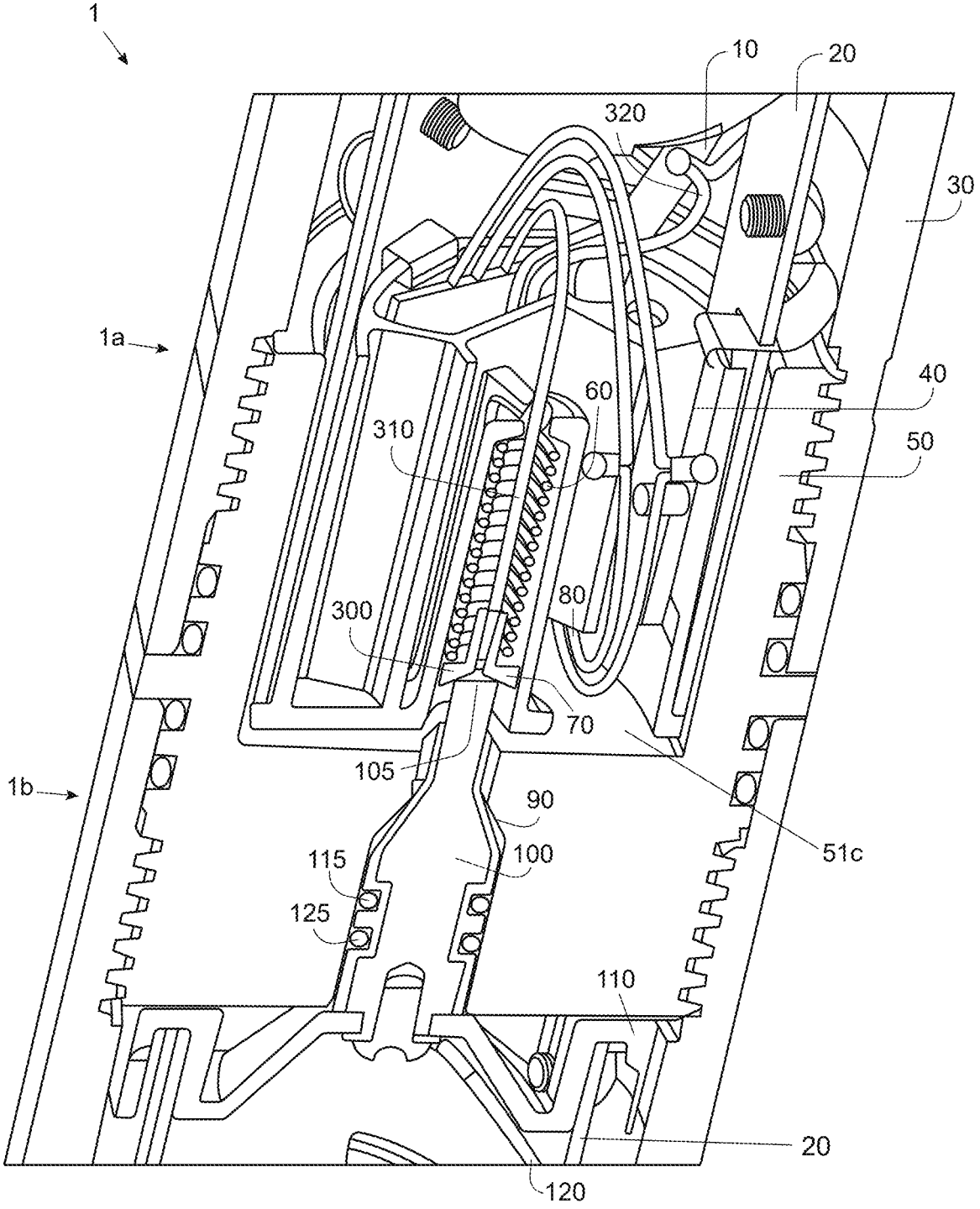
FIG. 3 is perspective section view of a portion of the perforating gun of FIG. 2 in accordance with embodiments of the invention.
Figure 4:
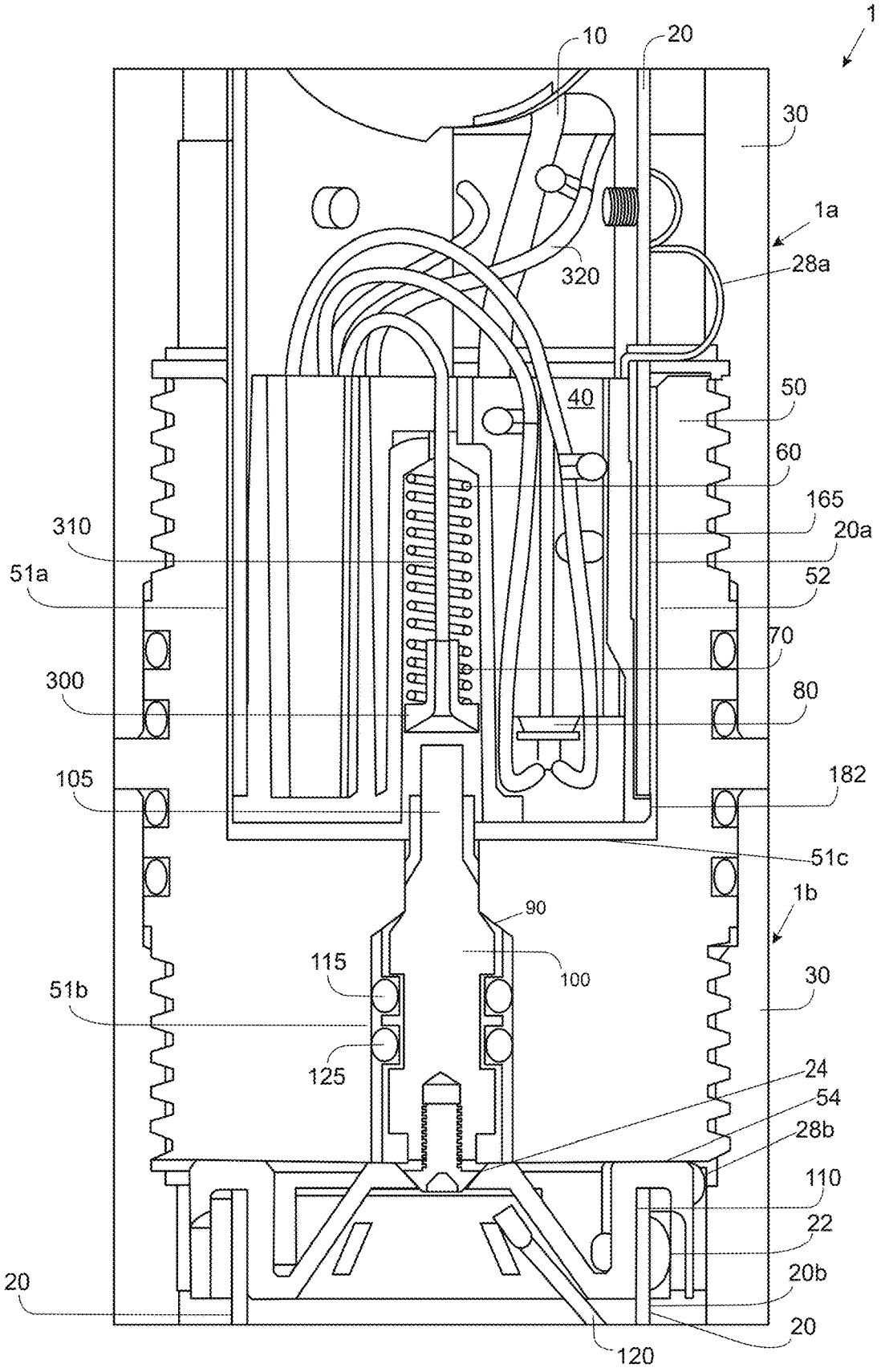
FIG. 4 is a section view of a portion of the perforating gun of FIG. 2 in accordance with embodiments of the invention.

Referring now to FIGS. 2, 3, and 4, in embodiments, the perforating gun 1 broadly includes, a charge carrier or charge tube 20, a barrel 30 that houses the components of the perforating gun 1, a one piece multi-function switch carrier 40, a tandem sub 50 for connecting gun clusters 55, a pin contact assembly 100 with pin 105 to provide an electrical connection between an upper and a lower gun, a pin contact spacer 110, and a through wire 120. It should be noted that FIGS. 2, 3, and 4 provide section views showing an area of connection between an upper gun 1*a* and a lower gun 1*b*. Each gun 1 is substantially the same, and is designed to connect to additional guns in order to create the perforating gun system 35, described above.

Figure 5A:
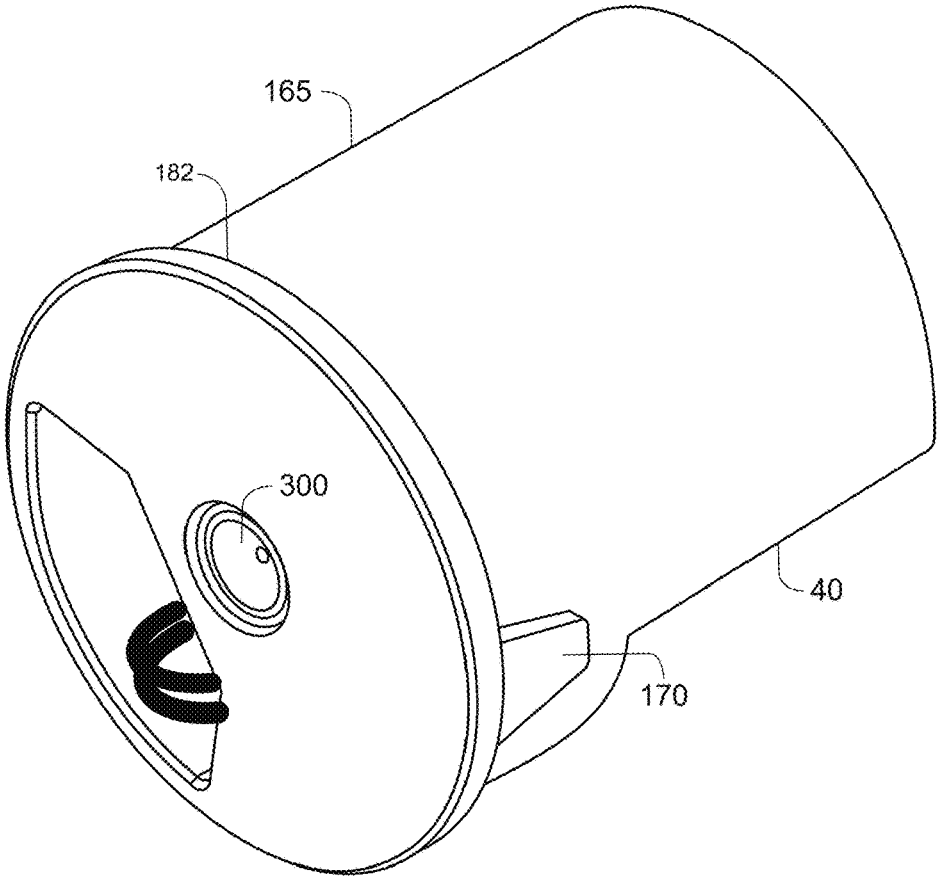
FIG. 5A is a perspective view of a multi-function switch carrier for use in a perforating gun in accordance with embodiments of the invention.
Figure 5B:
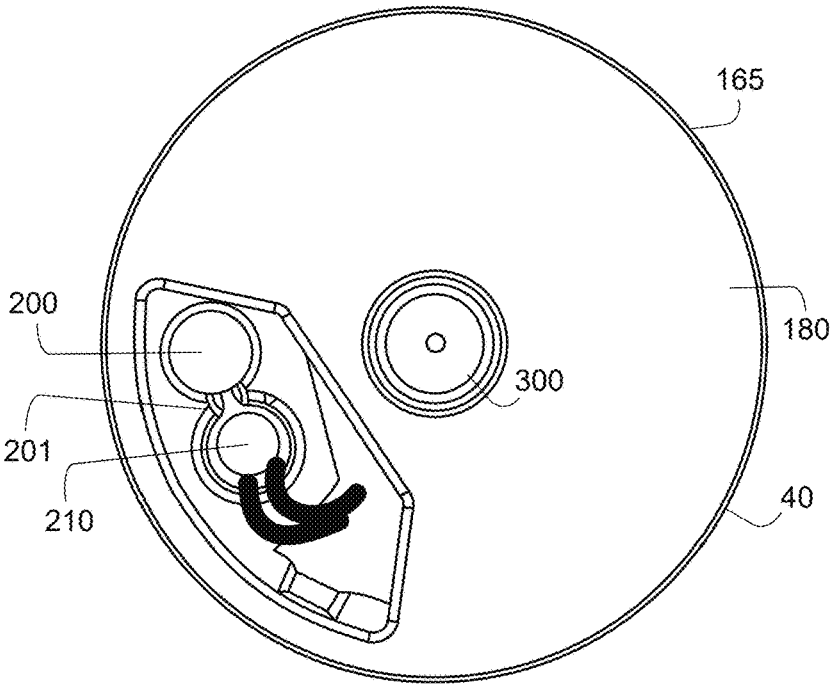
FIG. 5B is a top view of the multi-function switch carrier of FIG. 5A.
Figure 5C:
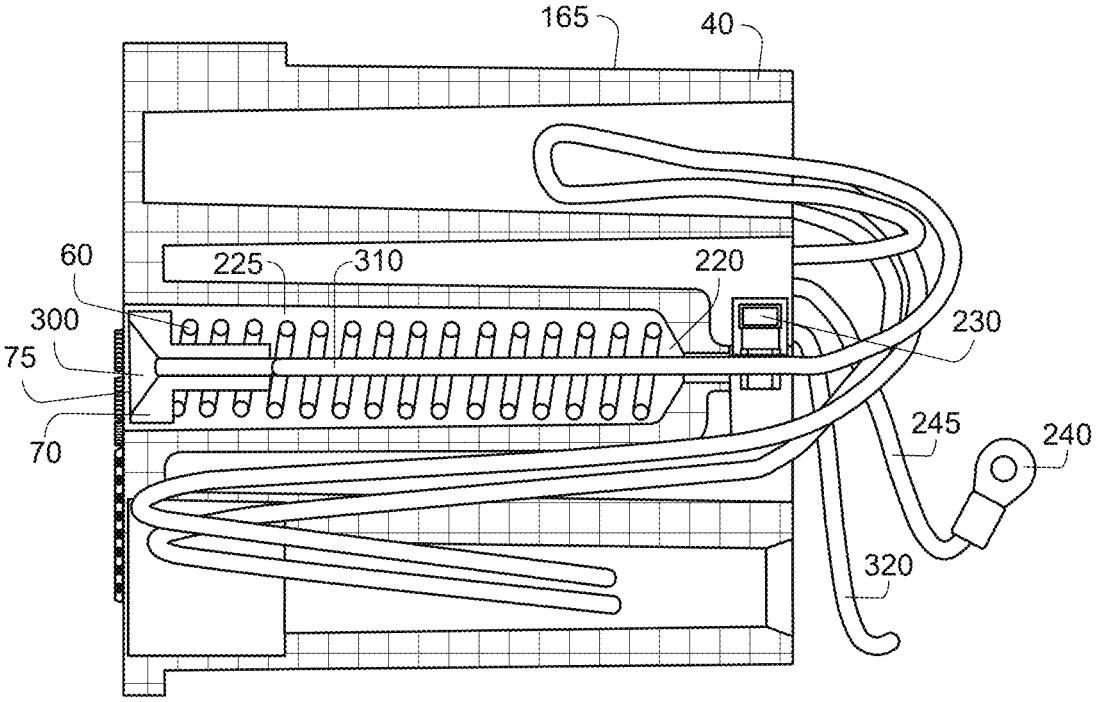
FIG. 5C is a section view of the multi-function switch carrier of FIG. 5A taken along line A-A in FIG. 5D.
Figure 5D:
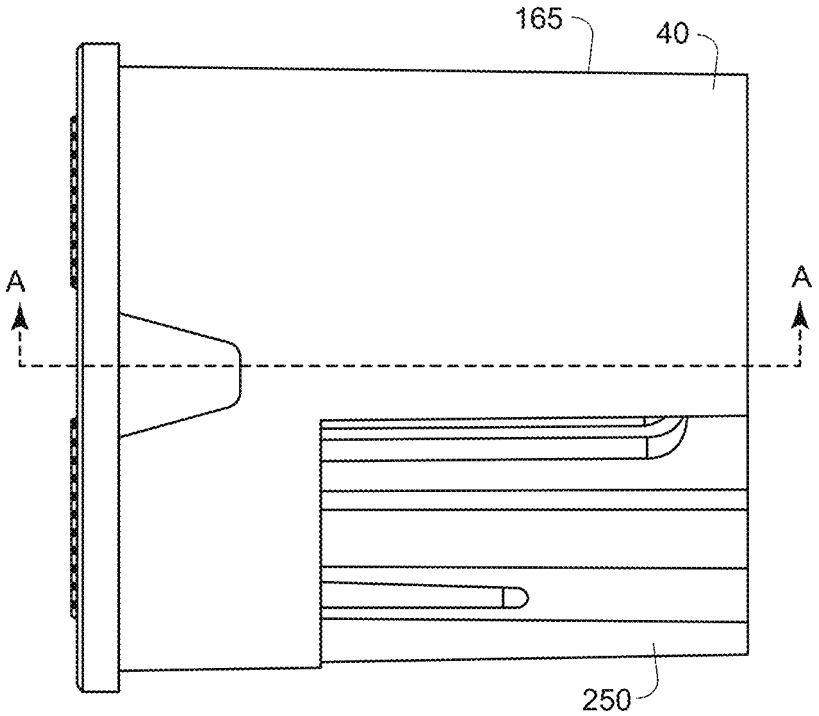
FIG. 5D is a side view of the multi-function switch carrier of FIG. 5A.
Figure 5E:
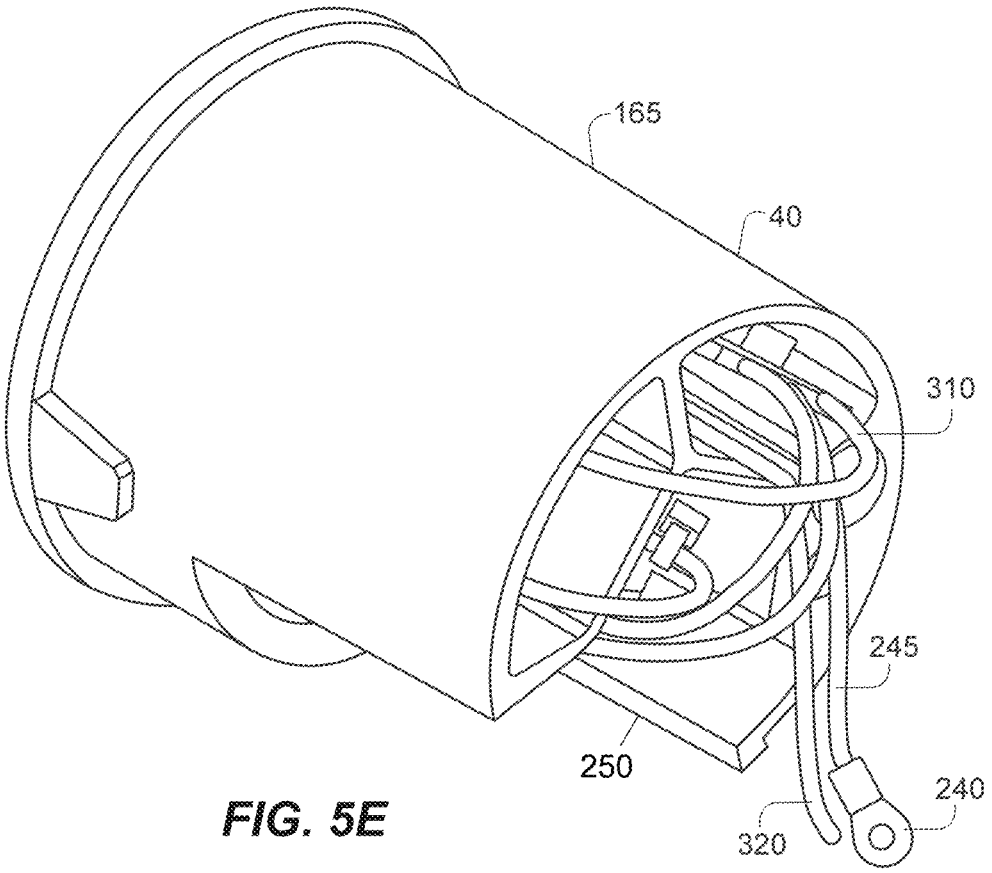
FIG. 5E is a rear perspective view of the multi-function switch carrier of FIG. 5A.
Figure 5F:
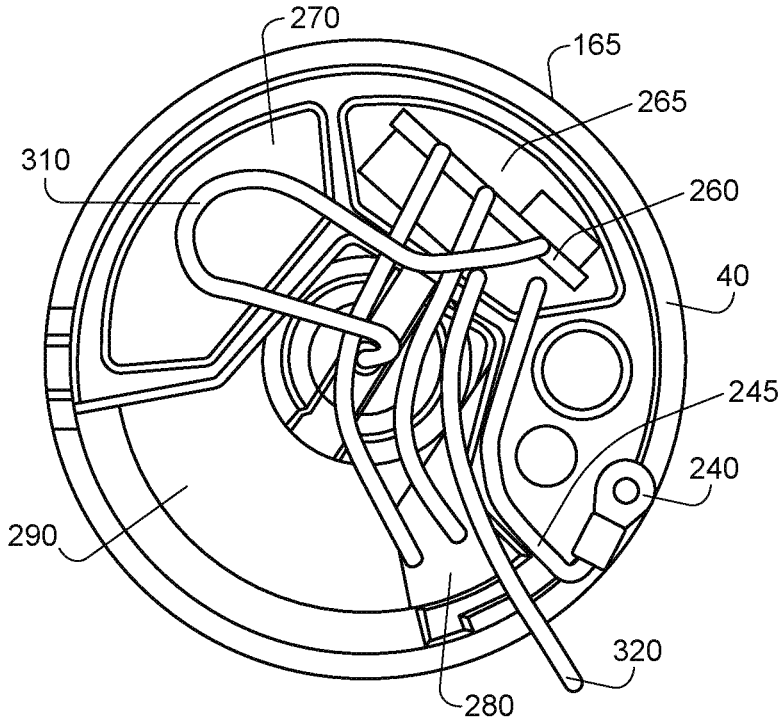
FIG. 5F is a rear view of the multi-function switch carrier of FIG. 5A.

Beginning with the tandem sub 50, which connects an upper gun 1*a* to a lower gun 1*b*, a bore 51 is formed through the length of the tandem sub 50. A first portion 51*a* of the bore 51 may have a larger diameter than a second portion 51*b*. The switch carrier 40, described in greater detail below, fits within the bore first portion 51*a*. The switch carrier 40 is entirely, or substantially entirely, positioned within the tandem sub 50. A flange 182 on a top face 180 (FIGS. 5A and 5B) of the switch carrier 40 defines a space along an outer wall 165 of the switch carrier 40. When the switch carrier 40 is installed into the tandem sub 50, the space is therefore between the switch carrier 40 and an inner wall 52 of the tandem sub 50. As with conventional tandem subs, the tandem sub 50 includes threading that is configured to engage with corresponding threading on the inside wall of the gun barrel 30 for securing the gun barrel 30 to the tandem sub 50. O-rings, which may be located between the tandem sub 50 and the gun barrel 30, may provide a seal between the tandem sub 50 and the gun barrel 30.

Moving on, as is known to those of skill in the art, the charge tube 20 holds the shaped charges 25 that are used to make perforations through the barrel 30 and into the rock formation. Here, the charge tube 20 may be equipped with one or more grounding springs 28*a* and 28*b*. Each of the grounding springs 28*a* and/or 28*b* may be flat springs and/or made of a flat spring material. The lower grounding spring 28*a* is secured to an outside wall at the bottom end of the charge tube 20 near the switch carrier 40, and compresses against the inside diameter of the barrel 30 when the charge tube 20 is inserted into the barrel 30. The pressure between the spring 28*a* and the barrel 30 when the barrel 30 is screwed onto the tandem sub 50 may cause the spring 28*a* to scrape against the inside of the barrel 30, which may remove any coating or light rust that may be present on the inside of the barrel 30. The contact of the spring 28*a* with the tandem sub 50 and the barrel 30, etched by the spring 28*a* during installation, ensures good electrical contact for electrical grounding. The spring 28*a* may additionally help to locate the charge tube 20 within the barrel 30. It shall be understood that the lower grounding springs 28*a* may but need not include multiple upper grounding springs 28*a*, e.g., two or more springs 28*a*.

The upper grounding spring 28*b* is attached to the outside wall at the top end of the charge tube 20 at the pin contact spacer 110. The spring 28*b* may be secured to the pin contact spacer 110 and the charge tube 20 via a rivet or similar fastener. The spring 28*b* may contact an inside diameter of the barrel 30 when the charge tube 20 is inside the barrel 30. Additionally, when the gun below (e.g., gun 1*b*) is attached to an upper gun (e.g., gun 1*a*), the spring 28*b* may come into contact with a face 54 of the tandem sub 50. As with spring 28*a*, etching may occur at the location of the contact of the spring 28*b* with the barrel 30 and/or the tandem sub 50 which may remove any coating or rust that would interfere with electrical grounding. The spring 28*b* may additionally help to locate the charge tube 20 within the barrel 30. It shall be understood that the upper grounding spring 28*b* may but need not include multiple upper grounding springs 28*b*, e.g., two or more springs 28*b*.

The charge tube 20 is configured to fit around the outer wall 165 of the switch carrier 40. More specifically, a portion 20*a* of a first end of the charge tube 20 fits around the outer wall 165 of the switch carrier 40 in the space defined by the flange 182. The charge tube 20 may substantially abut a bottom side of the flange 182, and an outer edge of the flange 182 may be substantially flush with the outer wall of the charge tube 20 when installed. In embodiments, the charge tube 20 may be fastened to the switch carrier 40 (e.g., via a rivet or the like).

Importantly, to assemble a gun 1, the switch carrier 40 with the charge tube 20 secured therearound, is inserted into the tandem sub 50, and more specifically into the bore first portion 51*a* such that the top face 180 of the switch carrier 40 rests substantially adjacent a bottom surface 51*c* of the bore first portion 51*a*, and the portion 20*a* of the charge tube 20 surrounding the charge carrier 40 is also received into the tandem sub 50. Because the switch carrier 40 and a portion of the charge tube 20 is located within the tandem sub 50, the overall length of the gun 1 may be reduced, and the charge tube 20 may be more securely centralized within the gun barrel 30. Further, locating the charge tube 20 at least partially within the tandem sub 50 provides additional contact between the charge tube 20 and the tandem sub 50 for electrical ground.

Figure 7:
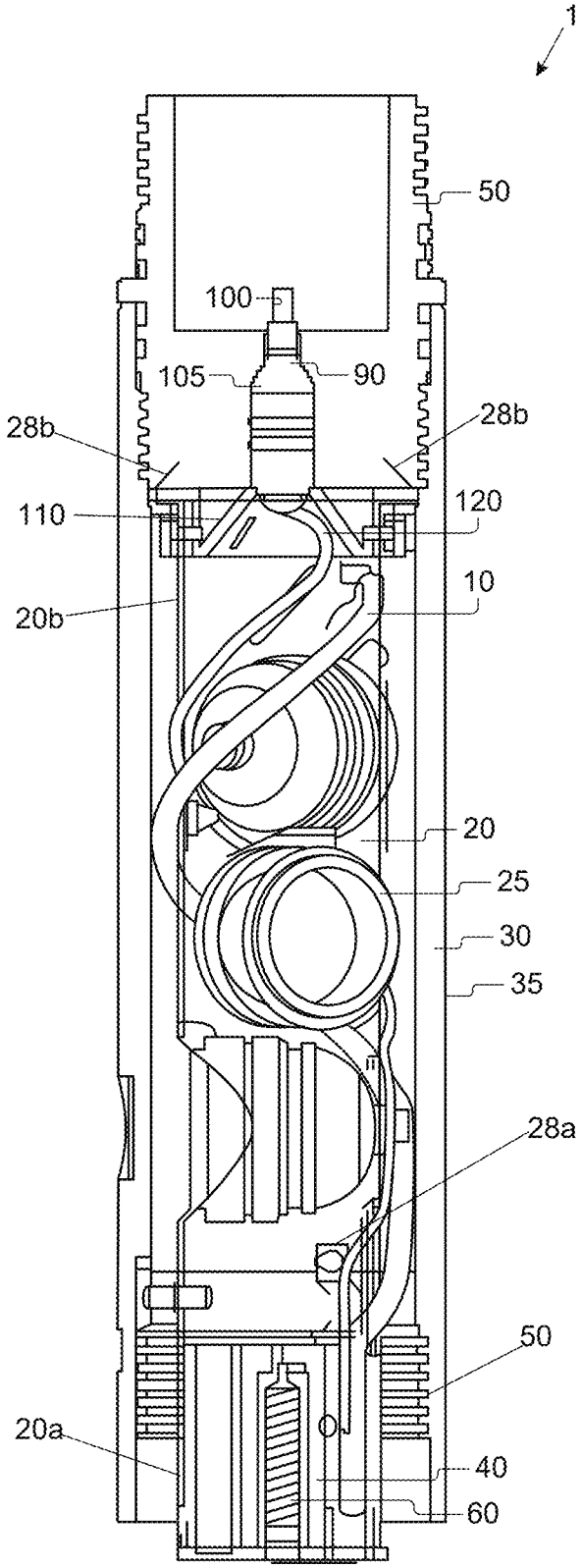
FIG. 7 is section view of a perforating gun according to embodiments of the invention.

A second end 20*b* of the charge tube 20, opposite the first end 20*a*, (FIG. 7 illustrates the spatial relationship between the second end 20*b* and the first end 20*a* of the charge tube 20) is operably connected to the pin contact spacer 110 via a fastener 22. A rivet 24 secures the pin contact assembly 100 to the pin contact spacer 110, and the pin contact assembly 100 extends upwardly from the pin contact spacer 110. In embodiments, an opening formed in the pin contact assembly 100 for receiving the rivet 24 is threaded to help maintain the rivet 24 within the opening. The rivet 24 may be formed a softer metal than the pin contact assembly 100 such that the rivet 24 conforms to the threading, thus preventing movement of the rivet 24, e.g., due to explosions in the lower gun 1*b*, and ensuring that the pin contact assembly 100 remains attached to the pin contact spacer 110. The rivet 24 may, but need not be, a multi-grip rivet.

The pin contact assembly 100 may have a core that is made of a metal that is a good conductor of electricity, and is relatively soft compared to steel. For example, the pin contact assembly 100 may be brass or other like material. The pin contact assembly 100 may be further covered in a nonconductive material in order to prevent shorting.

The electrical through wire 120 runs through the pin contact spacer 110 and includes a terminal ring. A crimped connection between the through wire 120 and the pin contact assembly 100 provides communication through the perforating gun system 35, reducing the number of electrical connections in the perforating gun system 35. A central portion of the pin contact assembly 100 is conically shaped to provide strength to the component. The conical shape may also help to focus the energy from explosions within the perforating gun system 35 (e.g., from a lower gun 1*b* toward an upper gun 1*a*, which can help to initiate the dynamic seal formed between the pin contact assembly 100 and the tandem sub 50.

As is shown in the figures, in an installed configuration, the pin contact spacer 110 of a lower gun (e.g., gun 1*b*) directly (or substantially directly) abuts the tandem sub 50. The pin contact assembly 100, which extends from the pin contact spacer 110 as described immediately above, is directed into the second portion 51*b* of the tandem sub 50 such that the pin 105 comes into contact with a conical surface 300 of a switch contact terminal 70 of the switch carrier 40 of an upper gun (e.g., gun 1*a*), thereby electrically linking the upper gun (e.g., gun 1*a*) and the lower gun (e.g., gun 1*b*). When the pin 105 contacts the switch contact terminal 70, the spring 60—which biases the switch contact terminal 70 towards the outer face 180 of the switch carrier 40—is compressed, ensuring that the electrical connection between the pin 105 and the switch contact terminal 70 is maintained. The spring 60 may or may not conduct an electrical signal. However, where a direct electrical connection between the pin 105 and the switch contact terminal 70 is established as described above, it may not be necessary for the spring 60 to conduct an electrical signal. This method of attaching the contact pin 105 to the charge tube 20, i.e., via the switch contact terminal 70, may reduce the number of electrical contacts and ease the assembly process. For example, in prior art guns, the pins are often installed in the tandem sub prior to making up to gun barrels and before making contact with other electrical connections in the cluster.

The charge tube 20 is thus centralized within the barrel 30 by means of engagement with the switch carrier 40 and the pin contact spacer 110. This is a more stable way of centralizing the charge tube 20 and may help to ensure better perforating performance and protect the explosives from hitting the inside of the barrel 30 while being deployed down into the wellbore. Also, when the charge tube 20 is made of metal it can provide additional means for conducting one side of the electrical communication, here referred to as ground. However, it shall be understood that the charge tube 20 may be made of other materials, such as plastic or cardboard, for example.

Referring again to the pin contact assembly 100, a plurality of O-rings 115 and 125 may surround the outside of the pin contact assembly 100. In embodiments, the O-rings 115 and/or 125 may be molded rubber or other various materials. The O-rings 115 and 125 may help to position the pin contact assembly 100 within the bore 51*b*. Additionally, the O-rings may provide an initial seal between clusters 55 (e.g., lower gun 1*b* and upper gun 1*a*). However, the seal provided by the O-rings may be insufficient to ensure a complete seal.

When detonation occurs in a cluster 55 immediately below the pin contact assembly 100 (e.g., in the lower gun 1*b*), the pressure from the detonation causes the pin contact assembly 100 to be projected upwards, further into the tandem sub 50. The upwards movement of the pin contact assembly 100 causes deformation of the pin contact assembly 100 against a high-pressure containing seat 90 of the bore 51*b*, as shown in FIG. 4. The contact location between the deformed pin contact assembly 100 and the high-pressure containing seat 90 creates a high-pressure seal between the lower gun 1*b* and the upper gun 1*a*. This high-pressure seal is effective to contain energy from the charges firing, hydrostatic pressure, and wellbore fluids.

This is particularly important, as rising wellbore fluids can prevent detonation of guns located higher in the gun system 35.

Detonation of the lower gun 1*b* may cause the connection between the pin 105 and the switch contact terminal 70 to be interrupted. More specifically, an impact of the contact pin 105 onto the mating conical surface 300 in the gun cluster 55 above as a result of the lower gun 1*b* firing may have a destructive effect, causing separation of the contact pin 105 and conical surface 300 as illustrated in FIG. 4. This separation between the guns 1*a*, 1*b* may give a positive signal 330 at surface to the operator computer 340. When current is applied to shoot the upper perforating gun 1*a*, the current goes from zero up to the required current for the instantaneous detonator 80 to fire and then back to zero, indicating proper function of that gun 1*b* as an open circuit.

Moving on, and referring now to FIGS. 5A, 5B 5C, 5D, 5E, 5F, 5G, and 5H the switch carrier 40 may be configured as a one-piece design that generally includes the outer wall 165 which may include an alignment key 170, the face 180 having a flange 182, the switch contact terminal 70, a hole 200 for receiving the detonation cord 10 and a hole 210 for receiving the instantaneous detonator 80 (together, the holes 200 and 210 are embodied in what is commonly known as a detonation block 201, or "det block"), and a spring tube 225 having an end 220.

The alignment key 170 on the outer wall 165 may mate with a corresponding cutout in the charge tube 20. The alignment key 170 is therefore visible from the outside of the charge tube 20 when the charge tube 20 is positioned around the switch carrier 40 as described above. The alignment key 170 may have multiple functions. For example, because the alignment key 170 corresponds to an opening in the charge tube 20, it ensures that the charge tube 20 is installed correctly around the switch carrier 40. Additionally, the alignment key 170 prevents the charge tube 20 from twisting about the outer wall 165 once installed, which can cause issues with the wires within the switch carrier 40. In other words, if the charge tube 20 tries to twist, the alignment key 170 will provide resistance and ultimately keep the charge tube 20 in the proper position relative to the switch carrier 40. Finally, the alignment key 170 is aligned with an alignment pin on the charge tube 20 that provides an indication of the direction of the shaped charges 25 within the charge tube 20. Typically, when the charge tube 20 is installed within the barrel 30, the alignment pin is no longer visible. Therefore, in order to verify the orientation of the charges 25 relative to scallops in the barrel 30, an operator has to look down the barrel 30 to find the pin and can then re-orient the charge tube 20 as necessary. Here, the alignment key 170 remains visible even when the charge tube 20 is installed into the barrel 30. The operator can therefore easily determine the alignment of the charges 25, and can re-orient the direction of the charges 25 if necessary. Once the charges 25 are aligned, a set screw may be tightened to secure the charges 25 in the desired orientation.

The outer wall 165 includes a generally flat area 250 for receiving a flush rivet for securing the switch carrier 40 to the charge tube 20.

Figure 5G:
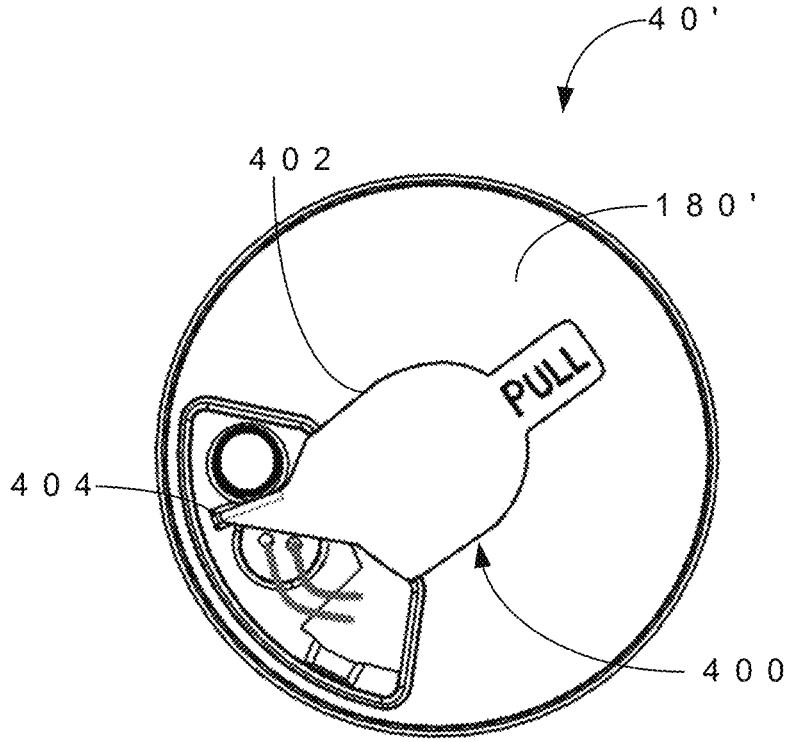
FIG. 5G is a top view of a multi-function switch carrier according to embodiments of the invention.
Figure 5H:
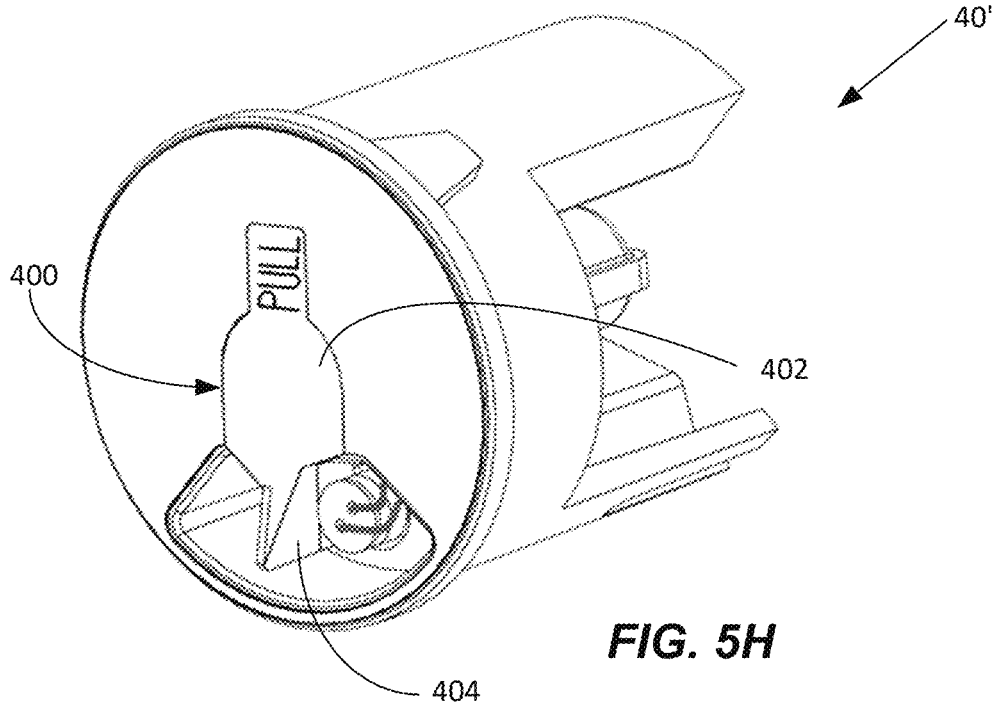
FIG. 5H is a perspective view of the multi-function switch carrier of FIG. 5G.

An opening in the face 180 of the switch carrier 40 provides access to the det block 201 such that an operator can insert and/or remove the detonator 80 and/or detonation cord 10 as necessary. FIGS. 5G and 5H show an alternative embodiment of a multi-function switch carrier 40', which is substantially similar to the switch carrier 40 except as is shown and/or described. Specifically, the switch carrier 40' is equipped with an interrupter 400 that partially covers the opening in the face 180'. The interrupter 400 includes a first portion 402 that covers the switch contact terminal 70 and a second portion 404 that extends between the detonation cord 10 and the detonator 80. The first portion 402 may be configured of a plastic material, while the second portion 404 may be metal. The first portion 402 and the second portion 404 may be adhered together to form the interrupter 400.

The first portion 402 serves as an electrical signal interrupter, preventing communication between guns (e.g., lower gun 1*b* and upper gun 1*a*). More directly, the first portion 402 covers the switch contact terminal 70 on the switch carrier 40, preventing the pin contact assembly 100 from engaging with the contact terminal 70. The first portion 402 may be releasably adhered to the face 180' of the switch carrier 40'. If the interrupter 400 is not removed prior to assembling the guns 1*a* and 1*b*, the operator will not be able communicate with all of the tools in the string as intended.

The second portion 404 serves as a detonation interrupter. For the gun 1 to work properly, a specific series of events has to take place, including events between the instantaneous detonator 80 and the detonation cord 10. The detonation interrupter 404 intentionally blocks these events to prevent premature detonation of the gun 1. Because the detonation interrupter 404 prevents unintentional detonation of the gun 1, the instantaneous detonator 80 and the detonation cord 10 can be installed in-shop, and the gun 1 can be transported to the fracking location as a substantially complete component. This is highly useful because it reduces the time it takes to complete final assembly of the gun system 35. But perhaps more importantly, field assembly errors can be greatly reduced or even eliminated. In traditional gun systems, the detonator 80 has to be inserted in the field. In some cases, the gun 1 has to be partially disassembled in order to insert the detonator 80 and/or to complete the necessary electrical connections. If the detonator 80 is inserted incorrectly, or the electrical connections are missing the gun 1 may not fire, or if it does fire, it may fire incorrectly (e.g., in the wrong direction). To the contrary, if the gun 1 is complete upon arrival at the fracking location, the field operators are not required to insert the detonator 80 on-sight, thus reducing field errors.

In use, when the field operator is ready for final assembly, the interrupter 400 can be easily removed by pulling it away from the face 180' of the switch carrier 40'. The upper gun 1*a* can then be mated with the lower gun 1*b* whereby the pin contact assembly 100 of the lower gun 1*b* engages with the switch contact terminal 70 in the switch carrier 40 of the upper gun 1*a*.

The compression spring 60 is situated in the spring tube 225. As is described above, the compression spring 60 biases the switch contact terminal 70 towards the switch carrier face 180. When two guns (e.g., upper and lower guns 1*a*, 1*b*) are installed together, the pin 105 of the pin contact assembly 100 abuts the switch contact terminal 70, compressing the spring 60 and pushing the switch contact terminal 70 towards the center of the switch carrier 40. The force from the spring 60 acting on the switch contact terminal 70 helps to maintain connection of the switch contact terminal 70 with the pin 105.

The addressable gun switch 260 is situated in a first designated hole 265 in the carrier 40, and a second designated hole 270 is provided to receive an additional gun switch 260, when applicable, or a switch for setting an isolation plug, for example. A third hole 280 may additionally be provided for end access.

The addressable gun switch 260 is configured for firing gun clusters 55 at specific times. During manufacture, the addressable gun switch 260 may have connecting wires as is known to those of skill in the art, and the wires may be sized for the needs for proper routing and distance as seen in FIGS. 5A, 5B, 5C, and 5D. A ground wire 245 has a ring terminal 240 that attaches to the charge tube 20 in an installed configuration. A wire 310 is passed from the addressable gun switch 260 inside the compression spring 60 and attaches directly to the switch contact terminal 70, providing a direct connection from the gun switch 260 to the contact pin 105 in the installed configuration, thus eliminating intermediary wires or connections. A cable tie 230 may be used to hold the wire 310 in place. In embodiments, the gun switch 260 is crimped with the wire inside in order to ensure a strong yet simple mechanical fastening. In each cluster 55, the wire 310 is connected to a wire 320 on the gun switch 260, and the wire 320 is connected to the through wire 120, to provide electrical continuity through the tool string 185.

When assembling the gun 1 in the manufacturing process, the pin contact spacer 110 is fastened to the end 20*b* of the charge tube 20 prior to arriving on location. The shaped charges 25 are installed within the charge tube 20 prior to inserting the charge tube 20 into the barrel 30 and tandem sub 50. The last step in preparing each gun cluster 55 is to add detonator 80. Many gun system designs require the removal of the charge tube 20 from the barrel 30 to add the detonator 80, after which the charge tube 20 is reinserted into the gun barrel 30. Damage to the wires can occur when removing the charge tube 20 for adding shape charge 25 or detonator 80 potentially causing an electrical short and loss of communication. One benefit of the location of the hole 210 for receiving the detonation cord 80 is that the clusters 55 can be assembled prior to arriving on wellsite and immediately prior to making up tool string 185, the detonator 80 can be electrically connected and installed without removing the charge tube 20 from the barrel 30. However, as noted above, it may also be possible with the interrupter 400 to assemble each cluster 55 with the detonator 80 prior to arriving at the wellsite such that the technician must only remove the interrupter 400 and secure the guns 1 together as described herein.

Many different arrangements of the various component depicted, as well as components not shown, are possible without departing from the spirit and scope of the invention. Embodiments of the invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the invention. Further, it will be understood that certain features and subcombinations are of utility and may be employed within the scope of this disclosure. Further, various steps set forth herein may be carried out in orders that differ from those set forth herein without departing from the scope of the claimed methods. The specification shall not be restricted to the above embodiments. Any units of measurement provided herein are exemplary only and are not meant to specifically define the dimensions of the system.

What is claimed is:

1. A perforating gun system, comprising:

a perforating gun, comprising:

a charge tube having a first end and a second end for holding a shaped charge;

a switch carrier having a body with a lower face and a flange extending circumferentially around the lower face defining a space between the flange and the body, an addressable gun switch being housed within the body; and a pin contact spacer comprising a pin contact assembly extending outwardly from the pin contact spacer;

wherein:

the first end of the charge tube is positioned around the switch carrier in the space between the flange and the body; and the second end of the charge tube is secured to the pin contact spacer; and a tandem sub with a bore defined therethrough, the bore comprising a first bore section having a first diameter and a second bore section having a second diameter that is less than the first diameter.

2. The perforating gun system of claim 1, wherein the perforating gun further comprises a barrel, the barrel being configured to house the charge tube, the switch carrier, and the pin contact spacer.

3. The perforating gun system of claim 2, wherein the charge tube further comprises an upper grounding spring located at the second end thereof, and a lower grounding spring located at the first end thereof.

4. The perforating gun system of claim 3, wherein each of the upper grounding spring and the lower grounding spring contacts an inside surface of the barrel to activate grounding between the charge tube and the barrel.

5. The perforating gun system of claim 4, wherein each of the upper ground spring and the lower grounding spring scratches the inside surface of the barrel during installation of the charge tube into the barrel.

6. The perforating gun system of claim 1, wherein:

the second bore section comprises a high-pressure seat; and detonation of a shaped charge in a second perforating gun of the perforating gun system forces the pin contact assembly upwards into the tandem sub thereby deforming the pin contact assembly against the high-pressure seat and forming a high-pressure seal between the pin contact assembly and the high-pressure seat.

7. The perforating gun system of claim 1, wherein:

the switch carrier comprises a switch contact terminal, the switch contact terminal being biased towards the lower face by a spring;

the switch contact terminal is electrically connected to the addressable gun switch via a wire; and the pin contact assembly of the second perforating gun selectively directly abuts the switch contact terminal of the perforating gun thereby forming the electrical connection between the perforating gun and the second perforating gun.

8. The perforating gun system of claim 7, wherein the pin contact assembly is further electrically connected to a through wire, the through wire providing electrical current from the addressable gun switch to the perforating gun system.

9. The perforating gun system of claim 7, wherein the switch carrier further comprises an interrupter removably positioned over the switch contact terminal, the interrupter preventing the pin contact assembly from contacting the switch contact terminal until the interrupter is removed from the switch carrier.

10. The perforating gun system of claim 9, wherein the interrupter comprises a metallic portion, the metallic portion extending between a detonation cord and an instantaneous detonator housed in the switch carrier thereby preventing detonation until the interrupter is removed from the switch carrier.

11. A perforating gun, comprising:

a switch carrier body, comprising:

an addressable switch;

a spring tube within the body, the spring tube housing a spring, wherein the spring biases a switch contact terminal towards an outer surface of the switch carrier body, the switch contact terminal being directly electrically connected to the addressable switch;

a detonation block for holding a detonation cord and an instantaneous detonator; and a removeable interrupter configured to selectively prevent an electrical signal from passing through the switch contact terminal.

12. The perforating gun of claim 11, further comprising a charge tube comprising at least one grounding spring.

13. The perforating gun of claim 12, wherein the at least one ground spring contacts an inside wall of a gun barrel when the perforating gun is inserted into the gun barrel.

14. The perforating gun of claim 11, further comprising a pin contact spacer comprising a pin contact assembly secured to and extending outwardly from the pin contact spacer.

15. The perforating gun of claim 11, wherein the removable interrupter is further configured to prevent unwanted detonation of the instantaneous detonator.

16. A method of forming a perforating gun system, comprising:

providing a first perforating gun, comprising:

a switch carrier, comprising:

an addressable switch;

a spring tube housing a spring, wherein the spring biases a switch contact terminal towards an outer face of the switch carrier, the switch contact terminal being directly electrically connected to the addressable switch; and a detonation block; and a pin contact assembly;

providing first and second hollowed tandem subs, each tandem sub comprising a first hollowed section having a first diameter and a second hollowed section having a second diameter that is less than the first diameter;

positioning the switch carrier into the first hollowed section of the first tandem sub; and positioning the pin contact assembly into the second hollowed section of the second tandem sub.

17. The method of claim 16, further comprising:

providing a second perforating gun, the second perforating gun being substantially identical to the first perforating gun;

positioning the pin contact assembly of the second perforating gun into the second hollowed section of the first tandem sub such that the pin contact assembly of the second perforating gun is in direct contact with the switch contact terminal of the first perforating gun.

18. The method of claim 17, further comprising:

providing a third perforating gun, the third perforating gun being substantially identical to the first perforating gun;

positioning the switch carrier of the third perforating gun into the first hollowed section of the second tandem sub such that the pin contact assembly of the first perforating gun is in direct contact with the switch contact terminal of the third perforating gun.

19. The method of claim 17, wherein:

the first perforating gun further comprises a removeable interrupter configured to selectively prevent an electrical signal from passing through the respective pin contact assembly; and the method further comprises removing the interrupter from the first perforating gun prior to positioning the second perforating gun pin contact assembly into the second tandem sub.

20. The method of claim 19, wherein detonating shaped charges of the second perforating gun forces the pin contact assembly of the second perforating gun upwards and further into the first tandem sub causing deformation of the second perforating gun pin contact assembly, whereby a high-pressure seal is formed the between second perforating gun pin contact assembly and the first tandem sub.

* * * * *